US006464336B1

(12) United States Patent
Sharma

(10) Patent No.: US 6,464,336 B1
(45) Date of Patent: Oct. 15, 2002

(54) INK JET PRINTING WITH COLOR-BALANCED INK DROPS MIXED USING BLEACHED INK

(75) Inventor: Ravi Sharma, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/002,665

(22) Filed: Oct. 31, 2001

(51) Int. Cl.[7] ..... B41J 2/21
(52) U.S. Cl. ..... 347/43
(58) Field of Search ..... 347/43, 15, 98, 347/95, 7, 21

(56) References Cited

U.S. PATENT DOCUMENTS 4,382,262 A 5/1983 Savit
4,614,953 A 9/1986 Lapeyre
5,606,351 A 2/1997 Hawkins
5,967,044 A * 10/1999 Marschke ..... 101/363
6,055,004 A 4/2000 Fassler et al.
6,078,340 A * 6/2000 Jeanmaire et al. ..... 346/140.1
6,097,406 A 8/2000 Lubinsky et al.

* cited by examiner

*Primary Examiner*—Thinh Nguyen
(74) *Attorney, Agent, or Firm*—Milton S. Sales

(57) ABSTRACT

A drop-on-demand ink jet printing system includes a print head having at least one mixing chamber with a nozzle opening. A plurality of sources of color liquid ink and a source of bleach communicate with the mixing chamber. A flow controller adapted to selectably meter ink from the sources to the mixing chamber, whereby ink droplets of selectable color are prepared in the least one mixing chamber for delivery from the nozzle. The flow controller is further adapted to meter bleach into the mixing chamber after a droplet is delivered from the nozzle opening to thereby neutralize color ink remaining in the mixing chamber sufficiently such that a next desired color can be attained by adding ink of appropriate color to the mixing chamber. The bleach is universal as to the liquid ink colors, wherein all colors are neutralized thereby. There may be a bleach source associated with each liquid ink color. The bleach in each bleach source is color specific to its associated liquid ink color, wherein only selected colors are neutralized thereby.

8 Claims, 4 Drawing Sheets

INK JET PRINTING WITH COLOR-BALANCED INK DROPS MIXED USING BLEACHED INK

CROSS REFERENCE TO RELATED APPLICATIONS

Reference is made to commonly assigned, co-pending U.S. patent application Ser. No. 09/466,977 entitled CONTINUOUS COLOR INK JET PRINT HEAD APPARATUS AND METHOD, filed in the name of John A. Lebens on Dec. 17, 1999.

FIELD OF THE INVENTION

This invention relates generally to ink jet printing and, more particularly, to methods and apparatus for generating color balanced ink drops in a drop on demand ink jet printer.

BACKGROUND OF THE INVENTION

Ink jet printing is a prominent contender in the digitally controlled electronic printing arena in part because of its non-impact and low-noise characteristics, its use of plain paper, and its avoidance of toner transfers and fixing. Ink jet printing mechanisms can be categorized as either continuous ink jet or drop-on-demand ink jet.

Drop-on-demand ink jet printers selectively eject droplets of ink toward a printing media to create an image. Such printers typically include a print head having an array of nozzles, each of which is supplied with ink. Each of the nozzles communicates with a chamber, which can be pressurized in response to an electrical impulse to induce the generation of an ink droplet from the outlet of the nozzle. Many such printers use piezoelectric transducers to create the momentary pressure necessary to generate an ink droplet.

Drop-on-demand printers utilizing thermally-actuated paddles have also been suggested. Each paddle would include two dissimilar metals and a heating element connected thereto. When an electrical pulse is conducted to the heating element, the difference in the coefficient of expansion between the two dissimilar metals causes them to momentarily curl in much the same action as a bimetallic thermometer, only much quicker. A paddle is attached to the dissimilar metals to convert momentary curling action of these metals into a compressive wave that effectively ejects a droplet of ink out of the nozzle outlet.

Printing images in a plurality of colors is highly desirable. This has been effected by means of a plurality of streams of ink droplets emitted from a plurality of nozzles. However, the images produced in this way are in general binary in the sense that the number of colors available for each drop is limited to that of the number of associated ink reservoirs and nozzle sets.

Commonly assigned U.S. Pat. No. 5,606,351, which issued to Gilbert A. Hawkins on Feb. 25, 1997, discloses a system having the ability to control the intensity of color droplets by mixing two or more fluid ink components (dyes, pigments, etc.) drawn into a chamber from refill channels. As such, each ink ejector squirts an ink of a particular color of varying intensity and is not capable of altering the color. That is, only the tone of the color is altered.

Commonly assigned U.S. Pat. No. 6,097,406, which issued to Anthony A. Lubinsky et al. on Aug. 1, 2000, discloses an apparatus for mixing and ejecting mixed colorant drops. A mixing chamber receives the appropriate amounts of primary colors and a drop is ejected. However, a residual amount of dye is left in the chamber and needs to be removed by flushing with a clear cleaning fluid before the next color is prepared. A separate diluent chamber is used to control color density.

Commonly assigned, co-pending U.S. patent application Ser. No. 09/466,977 entitled CONTINUOUS COLOR INK JET PRINT HEAD APPARATUS AND METHOD, filed in the name of John A. Lebens on Dec. 17, 1999, discloses a scheme for color mixing in a continuous ink jet print head. By selectively restricting flow of two or more different color inks to a nozzle, a range of colored inks can be ejected from the nozzle.

U.S. Pat. No. 4,614,953, which issued to James M. Lapeyre on Sep. 30, 1986, discloses a color inkjet printing mechanism in which real time color mixing is achieved in a single channel. The method is said to be applicable to either drop-on-demand or continuous stream ink jet printer heads. According to the Lapeyre patent, the relative sizes of a mixing chamber line and its subsequent drive chamber mixed ink drive interior are such that a continuous flow of in is maintained without significant mixing or blurring of different colors suquentially provided within the ink flow.

U.S. Pat. No. 4,382,262, which issued to Joseph Savit on May 3, 1983, discloses a method for ink jet printing in which a first dye component is printed on a receiver. One of several complementary dye components is selectively provided by dedicated nozzles, thereby producing a selected color.

Commonly assigned U.S. Pat. No. 6,055,004, which issued to Werner Fassler et al. on Apr. 25, 2000, discloses a microfluidic printing array print head. Micropumps are used to deliver various colors into a nozzle area to create a drop of desired color. The colored drop is then transferred to a receiver by contact. A shutter plate is used to control ink flow.

DISCLOSURE OF THE INVENTION

According to a feature of the present invention, a drop-on-demand ink jet printing system includes a print head having at least one mixing chamber with a nozzle opening. A plurality of sources of color liquid ink and a source of bleach communicate with the mixing chamber. A flow controller adapted to selectably meter ink from the sources to the mixing chamber, whereby ink droplets of selectable color are prepared in the least one mixing chamber for delivery from the nozzle. The flow controller is further adapted to meter bleach into the mixing chamber after a droplet is delivered from the nozzle opening to thereby neutralize color ink remaining in the mixing chamber sufficiently such that a next desired color can be attained by adding ink of appropriate color to the mixing chamber.

According to one preferred embodiment of the present invention, the bleach is universal as to the liquid ink colors, wherein all colors are neutralized thereby.

According to one preferred embodiment of the present invention, there is a bleach source associated with each liquid ink color. The bleach in each bleach source is color specific to its associated liquid ink color, wherein only selected colors are neutralized thereby.

Advantages associated with the present invention include the ability to produce continuous tone images without the associated need to print with smaller drops to avoid image pixels being filled by only one drop. For example, the image pixel of a 300 dpi printer is approximately 84 micron square, requiring a 60 micron diameter drop for a spread factor of two when the drop impacts paper. The nozzle diameter may therefore be close to 60 microns. Such large nozzles are less likely to clog and therefore are more robust. Furthermore, large nozzles are easily cleaned. Large nozzles may also employ more viscous inks putting less demand on ink formulation.

The method of controlling color by adding dye and bleach provides a unique means of obtaining color balance on demand. This method allows single drop per image pixel printing with any color of choice color with many levels of intensity.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
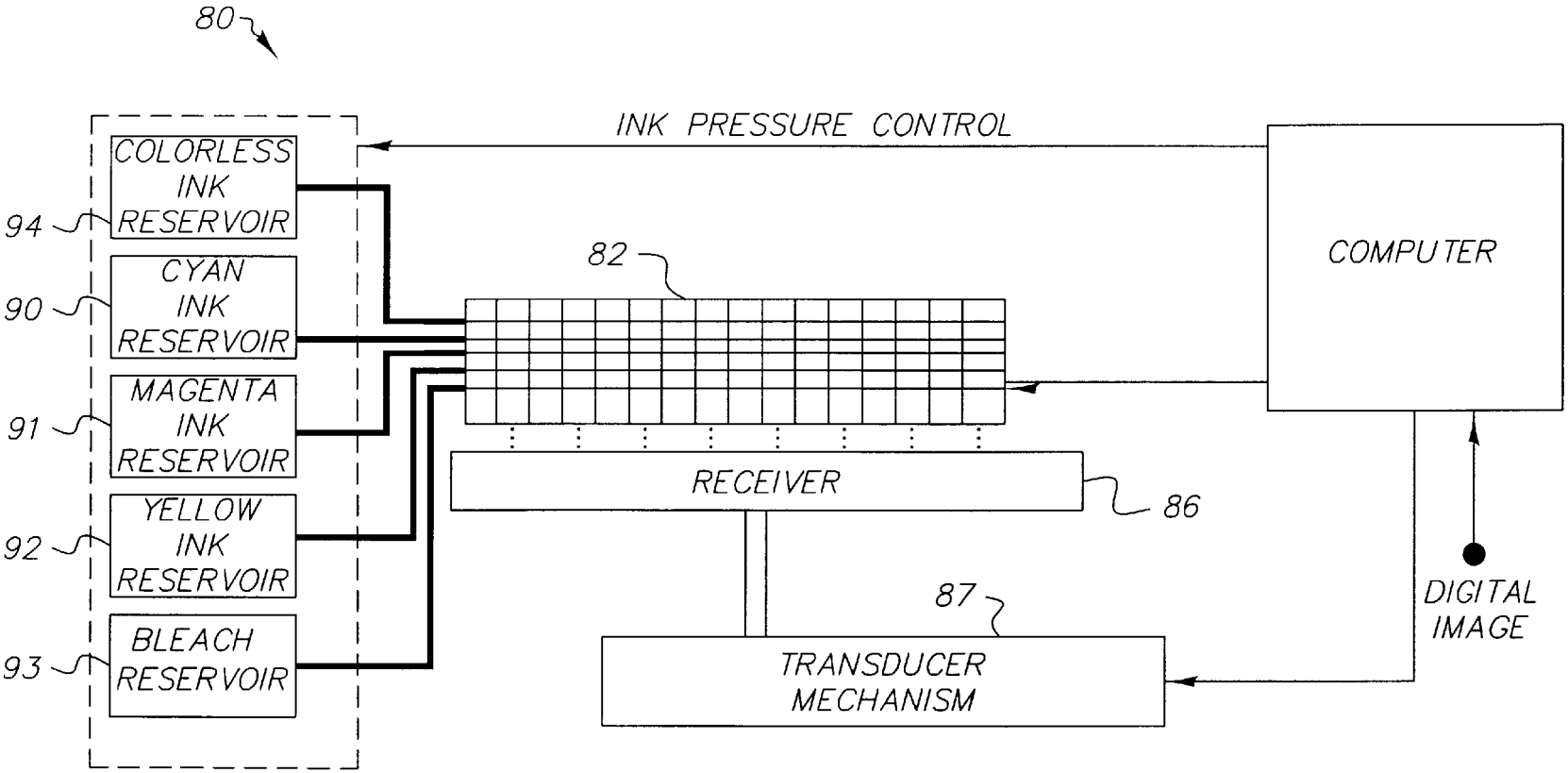
FIG. 1 is a schematic view of an ink jet printer according to a preferred embodiment of the present invention wherein a universal bleach reservoir is connected to a mixing chamber.
Figure 2:
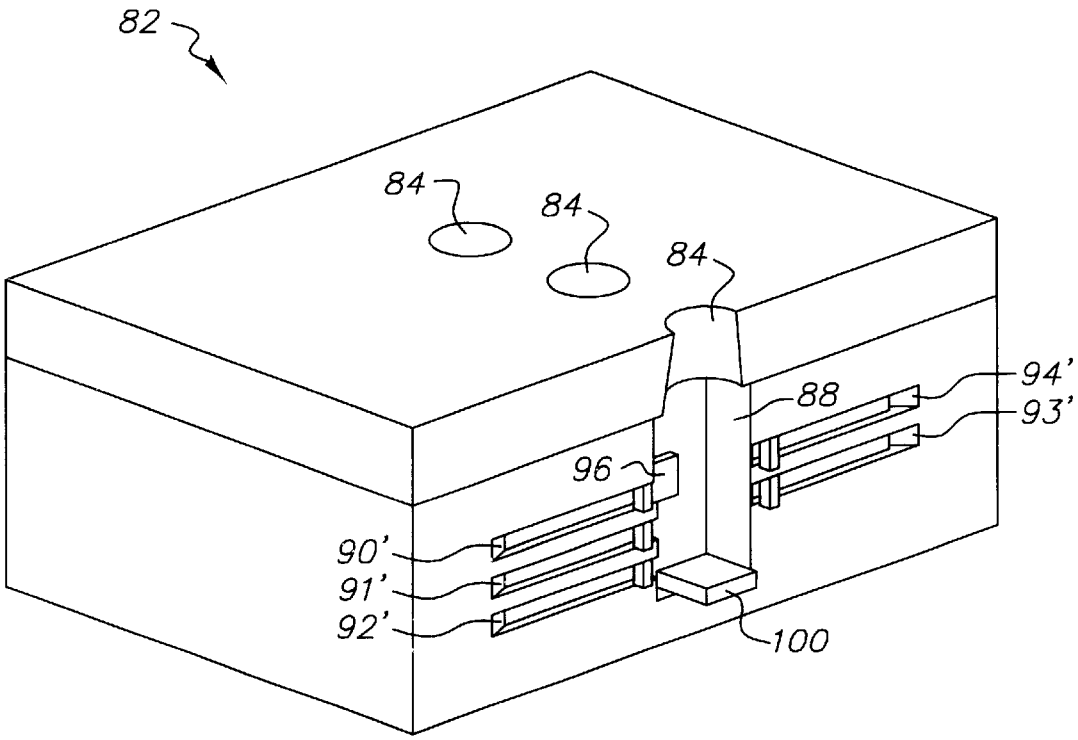
FIG. 2 is a perspective view of a print head suitable for use in the printer of FIG. 1.

Referring to FIGS. 1 and 2, another embodiment of present invention is illustrated wherein an ink jet printer 80 uses a drop-on-demand print head 82 having a plurality of nozzle openings 84 in FIG. 2 for delivering ink drops of varying color to a receiver 86 moved relative to print head 82 by a computer-controlled transducer 87. Each nozzle opening 84 is in communication with an ink mixing chamber 88 which receives selected quantities of dye solutions (cyan, magenta and yellow), universal bleach, and colorless ink from reservoirs 90–94 via passages 90'–94', respectively, to create an appropriate color for an ink drop to be delivered at an image pixel being addressed. The reservoirs may be pressurized so that flow occurs once a valve, not shown, is opened. Alternatively, a pump may be used to deliver liquid from the reservoirs to the mixing chamber.

A color mixture corresponding to the color to be deposited into an image pixel being addressed is prepared by metering in the appropriate amount of dyes, colorless ink and bleach. A mixer 96 is optionally provided in mixing chamber 88. Any device that causes a disturbance in the liquid present in the mixing chamber would function as a mixer. For example, mixer 96 may be a heater, piezoelectric transducer, micropump, thermally actuated flipper, piezoelectrically-driven flipper, or electrostatically driven vibrating plate. Once the color inks are mixed, an ink drop is ejected by an ejector 98.

Fluid flow control throughout the system may be effected by microvalves and micropumps. Any of many microvalves disclosed in the literature may be used in systems according to the present invention. For example, a bimetallically driven diaphragm is disclosed in Understanding Microvalve Technology, 26 Sensors, September 1994. Other types of microvalves are disclosed in U.S. Pat. Nos. 5,178,190; 5,238,223; 5,259,757; 5,367,878; 5,400,824; and 5,880,752. Any of many micropumps disclosed in the literature may be used with the present invention, as for example, electroosmotic pumps, acoustic pumps, or piezoelectrically driven membrane pumps.

The ink ejector provided in mixing chamber 88 may be a resistor layer, such as TaAl, deposited of the floor of the mixing chamber. The resistive layer may be coated with an electrical passivation layer (e.g., SiNi and/or SiC) and also with a non-wetting passivation layer. When current is passed through the resistive layer, mixed ink is rapidly heated, causing an expanding gas bubble to eject a drop of mixed ink. Another type of ink ejector may be thermally-driven such as a bimetallic flipper paddle that bends toward nozzle opening 84 when energized with electricity. Heat released by the energized resistive strip causes differential expansion of one of the metallic layers in the bimetallic strip, causing the bimetallic paddle to flip rapidly and eject a drop of the mixed ink.

In the event that the next image pixel requires a different color, say, one requiring a more intense cyan, more cyan is accordingly metered from reservoir 90 into the mixing cavity. In the event that the next pixel requires less intense cyan, a universal bleach is added from reservoir 93 to neutralize all colors. In effect adding bleach creates colorless ink. After bleaching process is complete and universal bleach has been stochiometrically used up, appropriate amounts of cyan, magenta and yellow dyes or colorless ink are added for the image pixel to be printed. Process is repeated for next image pixel and so on.

If the image pixel to be addressed requires a color in which a multiple of constituent colors are of lower intensity, then sufficient bleach is added to obtain the lowest intensity color, followed by make-up dye solution to adjust the intensity of the other constituent colors.

Figure 3:
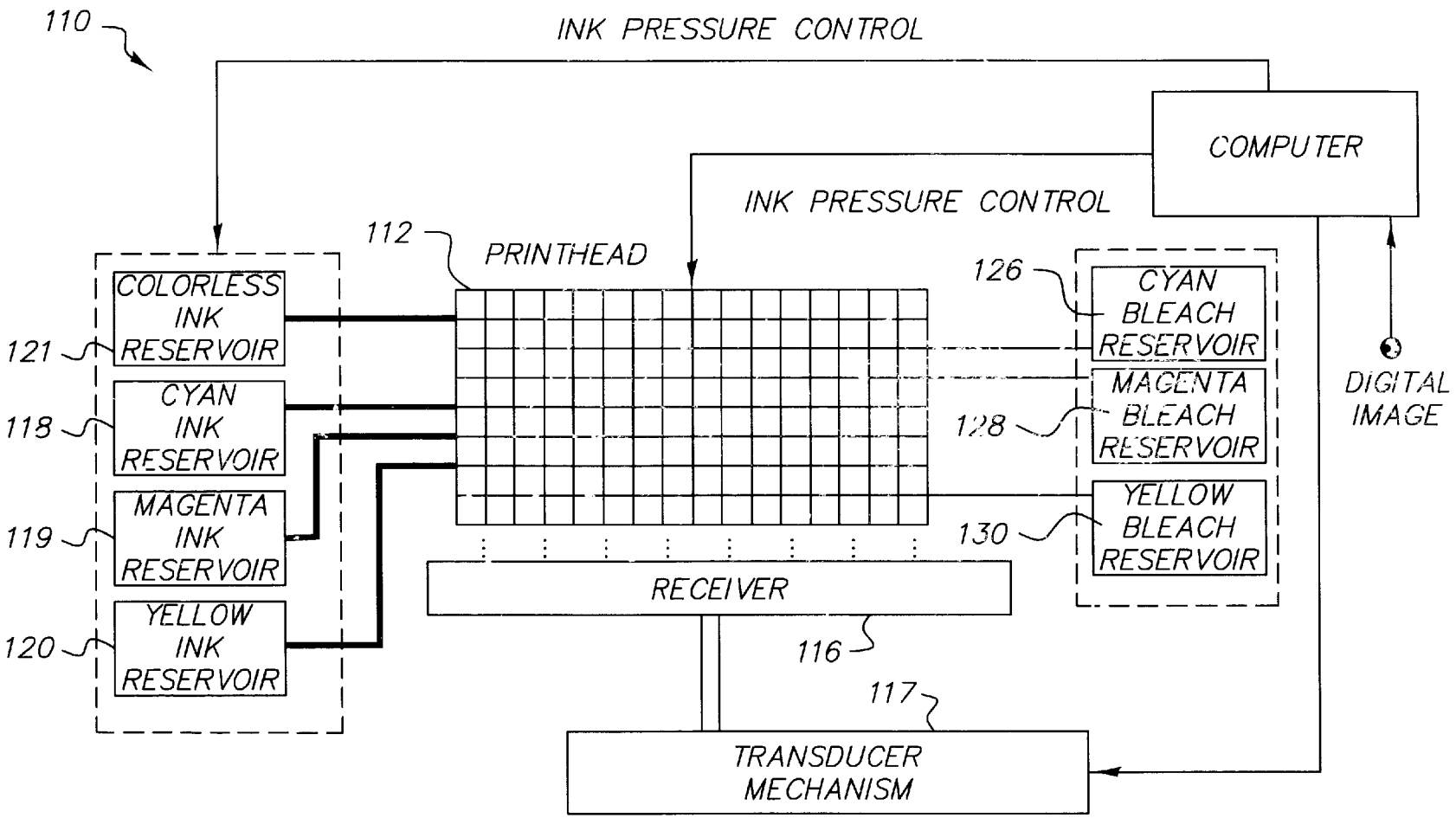
FIG. 3 is a schematic view of an ink jet printer according to another preferred embodiment of the present invention wherein color-specific bleaches are supplied to a mixing chamber.
Figure 4:
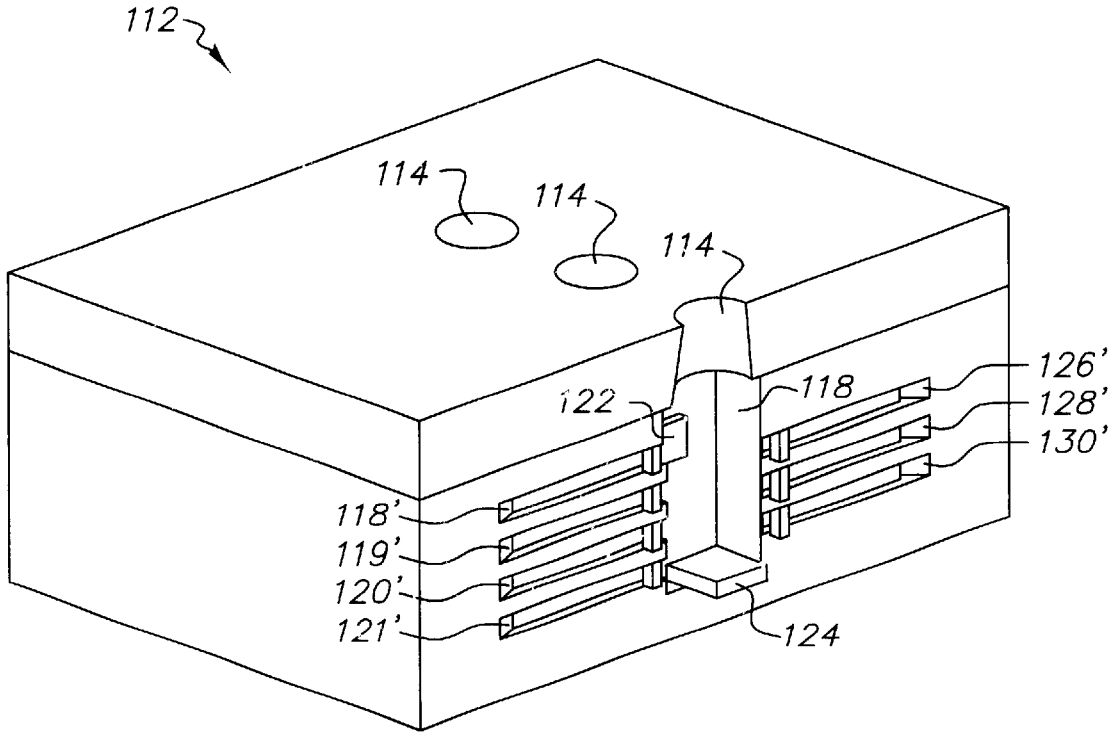
FIG. 4 is a perspective view of a print head suitable for use in the printer of FIG. 3.

Referring to FIGS. 3 and 4, another embodiment of present invention is illustrated wherein an ink jet printer 110 uses a drop-on-demand print head 112 having a plurality of nozzle openings 114 for delivering ink drops of varying color to a receiver 116. The receiver is moved relative to print head 112 by a computer-controlled transducer 117. Each nozzle opening 114 is in communication with an ink mixing chamber 118 which receives selected quantities of dye solutions (cyan, magenta and yellow), and colorless ink from reservoirs 118–121 via passages 118'–121', respectively, to create an appropriate color for an ink drop to be delivered at an image pixel being addressed. As in the previously-illustrated embodiments, the reservoirs may be pressurized so that flow occurs once a valve is opened or, a pump may be used to deliver liquid from the reservoirs to the mixing chamber. A mixer 122 is optionally provided in mixing chamber 118. Once the color is mixed, an ink drop is ejected by a ink drop ejector 124.

In the event that the next image pixel requires a different color, say, one requiring a more intense cyan, more cyan is accordingly metered into the mixing cavity. In the event that the next pixel requires less intense cyan, a cyanspecific bleach is added from a cyan bleach reservoir 126 via passage 126'. If the next pixel requires less intense magenta, a magenta-specific bleach is added from a magenta bleach reservoir 128 via passage 128'. In the event that the next pixel requires less intense yellow, a yellow-specific bleach is added from a yellow bleach reservoir 130 via passage 130'. In this way color balanced drops are prepared on demand for each image pixel.

Examples of colorants which may be mixed to form ink may be one of many found in the literature. For example, a colored ink may be formed by mixing acid blue 6 (cyan), basic red 29 (magenta) and Zeneca yellow 132 (yellow). A bleach that may be used to reduce or eliminate color is a 5% solution of sodium hypochlorite. Other bleaches that may be used include acids, bases, ozone, hydrogen peroxide, and nucleophiles.

The invention has been described in detail with particular reference to preferred embodiments thereof, but it will be understood that variations and modifications can be effected within the spirit and scope of the invention.

What is claimed is:

1. A drop-on-demand ink jet printing system for delivering droplets of selectable-color ink to a receiver; the system comprising:

a print head having at least one mixing chamber;

a nozzle opening associated with each of the at least one mixing chamber through which nozzle opening ink droplets are delivered from the associated mixing chamber to the receiver;

a plurality of sources of color liquid ink, each source (1) containing liquid ink of a different color and (2) communicating with the at least one mixing chamber;

a source of bleach communicating with the at least one mixing chamber, and a flow controller adapted to selectably meter ink from said sources to the at least one mixing chamber, whereby ink droplets of selectable color are prepared in the least one mixing chamber for delivery from the nozzle opening to the receiver, the flow controller being further adapted to meter bleach into the mixing chamber after a droplet is delivered from the nozzle opening to thereby neutralize color ink remaining in the mixing chamber sufficiently such that a next desired color can be attained by adding ink of appropriate color to the mixing chamber.

2. An ink jet printing system as defined in claim 1 further comprising an ejector associated with each of said mixing chambers, the ejector being adapted to cause an ink droplet to be expelled from the mixing chamber through the nozzle opening.

3. An ink jet printing system as defined in claim 1 further comprising a mixer associated with each of said mixing chambers to induce a disturbance in the liquid ink present in the mixing chamber.

4. An ink jet printing system as defined in claim 1 wherein the bleach is universal as to the liquid ink colors, wherein all colors are neutralized thereby.

5. An ink jet printing system as defined in claim 1 wherein:

there is a bleach source associated with each liquid ink color; and the bleach in each bleach source is color specific to its associated liquid ink color, wherein only selected colors are neutralized thereby.

6. A process as defined in claim 1 wherein:

there is a bleach source associated with each liquid ink color; and the bleach in each bleach source is color specific to its associated liquid ink color, wherein only selected colors are neutralized thereby.

7. A process for delivering droplets of selectable-color ink to a receiver from a print head having at least one mixing chamber and nozzle group; the process comprising:

communicating a plurality of liquid inks of a different color with the at least one mixing chamber;

communicating a colorless liquid ink with the at least one mixing chamber; and preparing ink droplets of selectable color by selectably metering different color inks to the at least one mixing chamber;

delivering the ink droplets of selectable color from the nozzle opening to the receiver; and metering bleach into the mixing chamber after a droplet is delivered from the nozzle opening to thereby neutralize color ink remaining in the mixing chamber sufficiently such that a next desired color can be attained by adding ink of appropriate color to the mixing chamber.

8. A process as defined in claim 7 wherein the bleach is universal as to the liquid ink colors, wherein all colors are neutralized thereby.

* * * * *